US005880419A

United States Patent [19]

Chou

[11] Patent Number: 5,880,419

[45] Date of Patent: Mar. 9, 1999

[54] SELECTIVE SWITCH

[75] Inventor: Chin-Wen Chou, Taipei, Taiwan

[73] Assignee: Shin Jiuh Corp., Taipei Hsien, Taiwan

[21] Appl. No.: 987,385

[22] Filed: Dec. 9, 1997

[30] Foreign Application Priority Data

Oct. 18, 1997 [TW] Taiwan ..... 86217637

[51] Int. Cl.[6] ..... H01H 23/20

[52] U.S. Cl. ..... 200/6 R; 200/433; 200/557; 200/339

[58] Field of Search ..... 200/6 R, 6 BA, 200/16 C, 339, 408, 433, 553, 557

[56] References Cited

U.S. PATENT DOCUMENTS

| | | | |
|---|---|---|---|
| 4,170,725 | 10/1979 | Farrell | 200/433 |
| 4,777,333 | 10/1988 | Valenzona | 200/433 |
| 5,051,550 | 9/1991 | Harris | 200/339 X |
| 5,196,657 | 3/1993 | Jensen | 200/6 R |

FOREIGN PATENT DOCUMENTS

| | | | |
|---|---|---|---|
| 1417064 | 8/1988 | U.S.S.R. | 200/339 |

*Primary Examiner*—Renee S. Luebke
*Attorney, Agent, or Firm*—Finnegan, Henderson, Farabow, Garrett & Dunner, L.L.P.

[57] ABSTRACT

A selective switch includes a switch housing, and a button cap with two opposite side portions. A contact assembly includes first, second and third conductive members which are all fixed in the switch housing. A helical spring is mounted in the switch housing, and has an outer end portion to support the button cap thereon and an inner end portion adjacent to the contact assembly. A flexible mandrel has an inner end portion and an outer end portion which is integrally formed with the outer end portion of the helical spring. The helical spring extends around the flexible mandrel. A movable contact member is in electrical contact with and is carried on the inner end portion of the flexible mandrel to move between a first position in which the contact member is in electrical contact with the first and second conductive members in response to depression of one of the side portions of the button cap, and a second position in which the contact member is in electrical contact with the second and third conductive members in response to depression of the other one of the side portions of the button cap.

5 Claims, 5 Drawing Sheets

SELECTIVE SWITCH

BACKGROUND OF THE INVENTION

1. Field of the Invention

This invention relates to a selective switch, more particularly to a selective switch which has a unitary spring member for rapid change between two different connecting states.

2. Description of the Related Art

Selective switches are usually employed in electric appliances to control the operation of the latter in two different operating states. Referring to FIG. 1, a conventional selective switch is shown to include a button cap 10 which is mounted on a switch housing and which has an annular flange to form a receiving space 16. A rigid rod 11 is received in the receiving space 16 and extends downward for coupling with a contact plate 12. The contact plate 12 can be driven by the rod 11 to move between a first position in which the contact plate 12 is in contact with first and second conductive members 13, 14 in response to depression of one side of the button cap 10, and a second position in which the contact plate 12 is in contact with first and third conductive members 13, 15 in response to depression of the other side of the button cap 10. A spring 17 surrounds tightly the rigid rod 11 and biases the contact plate 12 for contact with appropriate ones of the conductive members 13, 14, 15. The drawbacks of the conventional selective switch are as follows:

1. A strong pushing force must be applied on the button cap 10 when changing switching states since the rigid rod 11 is used to move the contact plate 12. Moreover, the switching action is relatively slow.
2. A clearance is formed between the contact plate 12 and the conductive members 14, 15 during movement of the contact plate 12 between the first and second positions, thereby resulting in an electric arc which can burn down and destroy the selective switch.
3. The size of the selective switch cannot be reduced because of the presence of the rigid rod 11.

SUMMARY OF THE INVENTION

The main object of the present invention is to provide a selective switch which has a unitary spring member that is adapted to actuate a movable contact member for contact with appropriate conductive members when changing between two different connecting states.

According to this invention, a selective switch includes a switch housing, and a button cap with two opposite side portions. A contact assembly includes first, second and third conductive members which are all fixed in the switch housing. A unitary spring member includes a helical spring and a flexible mandrel. The helical spring is mounted in the switch housing and has an outer end portion to support the button cap thereon and an inner end portion adjacent to the contact assembly. The flexible mandrel has an inner end portion and an outer end portion which is integrally formed with the outer end portion a of the helical spring. The helical spring extends around the flexible mandrel. A movable contact member is in electrical contact with and is carried on the inner end portion of the flexible mandrel to move between a first position in which the contact member is in electrical contact with the first and second conductive members in response to depression of one of the side portions of the button cap, and a second position in which the contact member is in electrical contact with the second and third conductive members in response to depression of the other one of the side portions of the button. As such, the flexible mandrel can move rapidly to change between the first and second switching states. Operation of the button cap feels less rigid by virtue of the unitary spring member.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
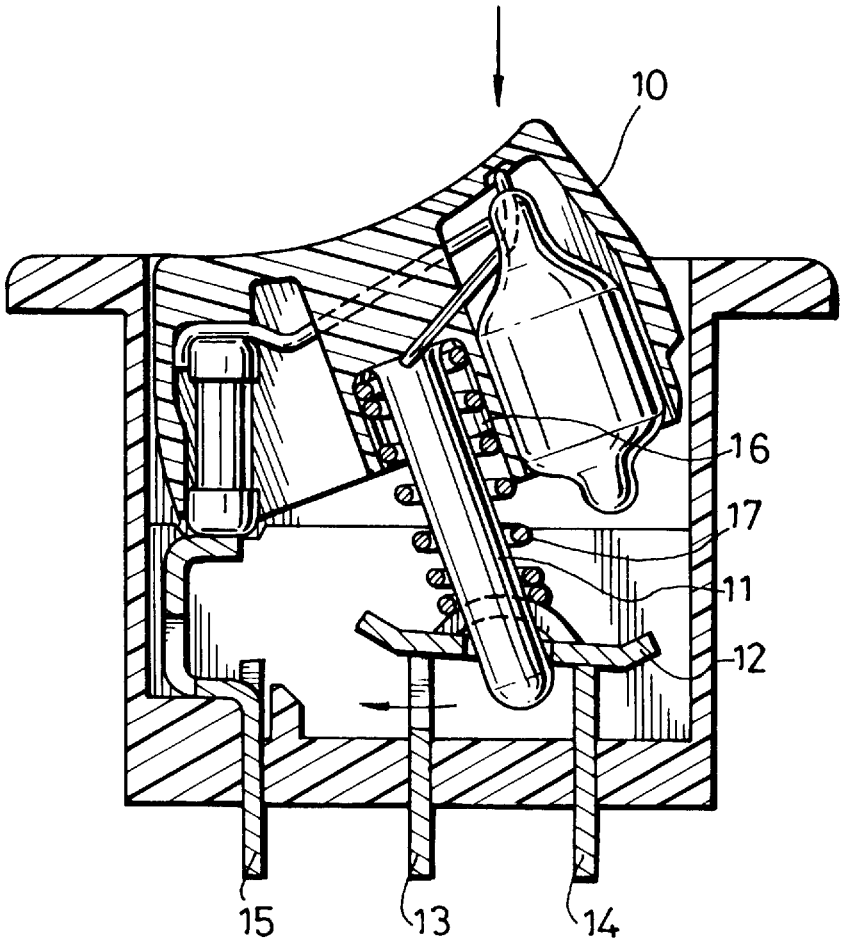
FIG. 1 PRIOR ART
FIG. 1 is a sectional view of a conventional selective switch.
Figure 2:
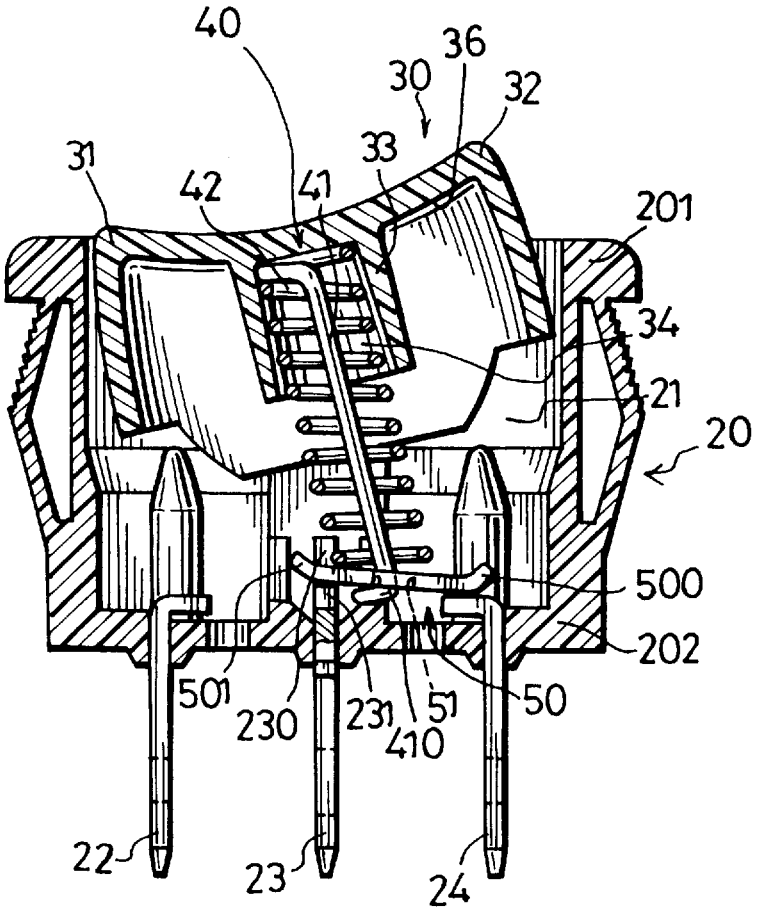
FIG. 2 is a sectional view of a preferred embodiment of a selective switch according to this invention in a first state.

Referring to FIG. 2, the preferred embodiment of a selective switch according to the present invention is shown to comprise a switch housing 20, a button cap 30, a unitary spring member 40, and a movable contact member 50.

Figure 5:
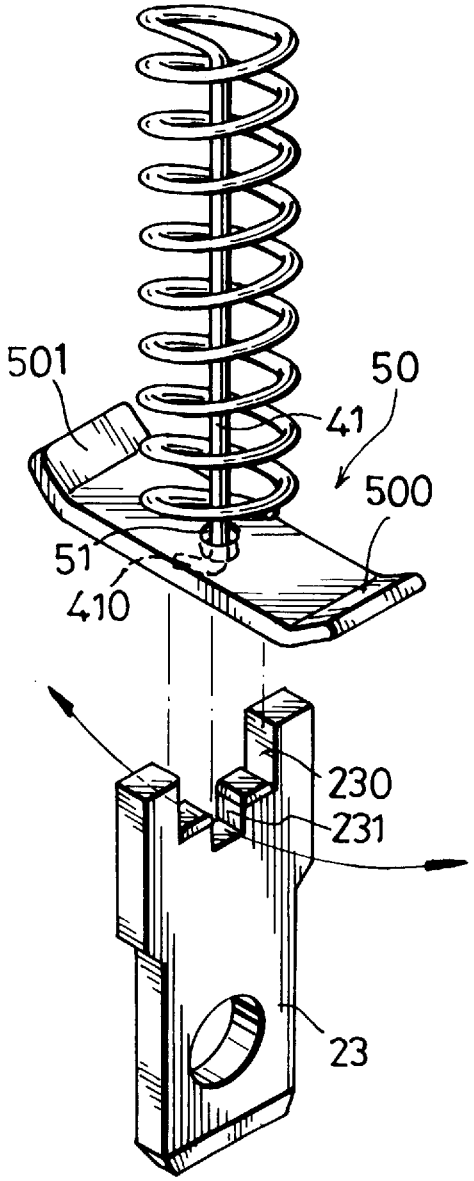
Fig. 5 is an exploded view of a portion of the selective switch of FIG. 2.

The switch housing 20 has a cavity 21, and top and bottom end portions 201, 202. A contact assembly includes first, second and third conductive members 22, 23, 24 which are all fixed in the switch housing 20 at the bottom end portion 202 and which extend out of the switch housing 20. As shown in FIG. 5, the second conductive member 23 has a cavity which includes a wider portion 230 and a narrower portion 231 that is communicated with the wider portion 230.

The button cap 30 is mounted on the switch housing 20 at the top end portion 201, and has two opposite side portions 31, 32 which are generally located above the first and third conductive members 22, 24, respectively. The button cap 30 has an inner surface 36 formed with an annular flange 33 between the side portions 31, 32. The annular flange 33 extends downwardly to define an elongated receiving space 34 therein. The receiving space 34 has a first end adjacent to the inner surface 36 and a second end opposite to the first end. The receiving space 34 has a circular cross-section which increases in diameter from the first end to the second end.

Figure 3:
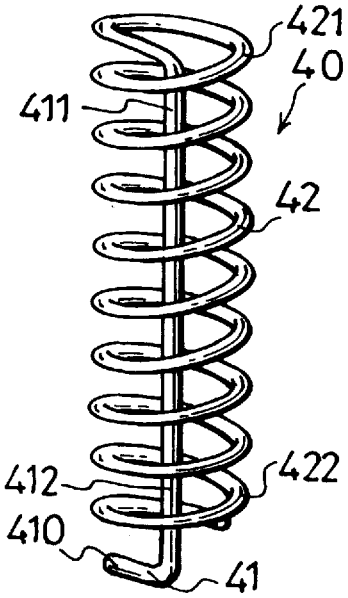
FIG. 3 is a perspective view showing a spring member of the embodiment of FIG. 2 in a normal state.

With reference to FIG. 3, the unitary spring member 40 is mounted in the cavity 21 of the switch housing 20 and includes a helical spring 42 and a flexible mandrel 41. The helical spring 42 has an outer end portion 421 which is received in the receiving space 34 of the button cap 30, and an inner end portion 422 which is adjacent to the contact assembly. The flexible mandrel 41 is generally L-shaped and has a straight body with an outer end 411 which is integrally formed with the outer end portion 421 of the helical spring 42 and an inner end portion 412. The inner end portion 412 is generally straight and has a bent part 410 perpendicular to the straight body.

The movable contact member 50, with reference to FIG. 5, is an elongated plate which has a through hole 51 formed therethrough. The bent part 410 of the flexible mandrel 41 extends through the through hole 51 such that the movable contact member 50 is clamped between the helical spring 42 and the inner end portion 412 of the flexible mandrel 41, thereby retaining the spring member 40 on the movable contact member 50. In addition, the contact member 50 is mounted slidably in the wider portion 230 of the cavity of the second conductive member 23.

Figure 4:
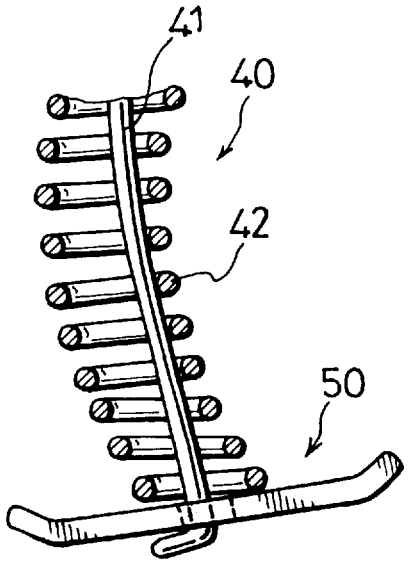
FIG. 4 is a side view showing the spring of FIG. 3 in a compressed state.
Figure 6:
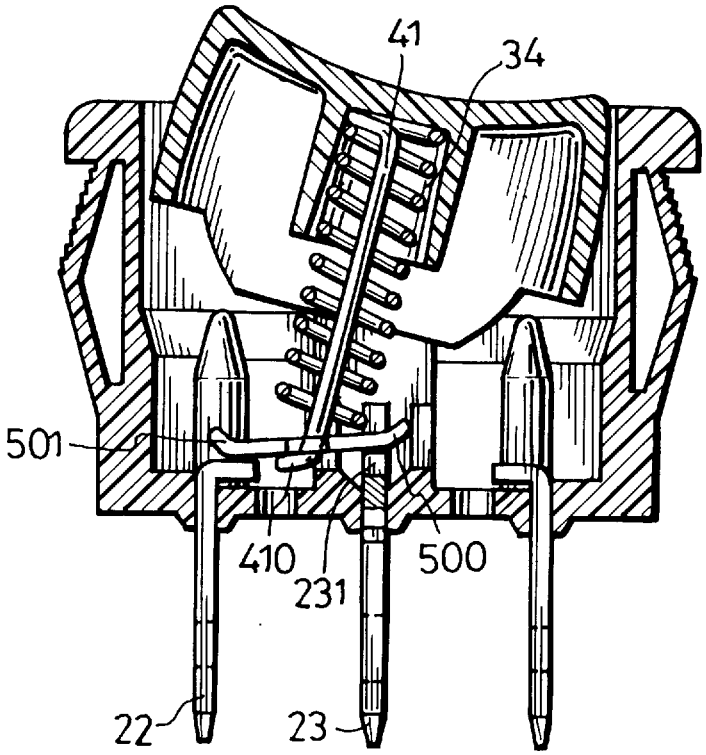
FIG. 6 is a sectional view showing the selective switch in a second state.

FIG. 2 shows the selective switch in a first connecting state in which two ends 500, 501 of the contact member 50 are in contact with the third and second conductive members 24, 23, respectively, when the side portion 31 of the button cap 30 is depressed. When the other side portion 32 is depressed, the button cap 30 acts as a lever which has a fulcrum at the annular flange 33. As shown in FIG. 4, the helical spring 42 and the mandrel 41 bend and accumulate spring force to enable rapid movement of the helical spring 42 and the mandrel 41 toward the side portion 31 so as to actuate the contact member 50 to slide in the same direction. As such, as shown in FIG. 6, the bent part 410 of the mandrel 41 passes through the narrower portion 231, and the end 501 of the contact member 50 is in contact with the first conductive member 22 to operate the switch in a second connecting state.

The advantages of the selective switch of this invention are as follows:

1. The mandrel 41 can move rapidly to change between the first and second switching states, thereby minimizing the risk of forming a clearance between the conductive members 22, 24 and the contact member 50 and the occurrence of an electric arc to prevent destruction of the switch.
2. By virtue of the unitary spring member 40, operation of the button cap 30 feels less rigid.
3. Since the helical spring 42 of the spring member 40 can be formed in different diameters, the size of the selective switch can be reduced to suit the intended application.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A selective switch, comprising:

a switch housing having a cavity;

a button cap having two opposite side portions;

a contact assembly including a first conductive member, a second conductive member and a third conductive member which are all fixed in said switch housing;

a unitary spring member including:

a helical spring mounted in said cavity and having an outer end portion which supports said button cap thereon at a position that is located between said opposite side portions, and an inner end portion which is adjacent to said contact assembly; and a flexible mandrel having an inner end portion and an outer end portion which is integrally formed with said outer end portion of said helical spring, said helical spring extending around said flexible mandrel; and a movable contact member being in electrical contact with and carried on said inner end portion of said flexible mandrel to move between a first position in which said contact member is in electrical contact with said first and second conductive members in response to depression of one of said side portions of said button cap, and a second position in which said contact member is in electrical contact with said second and third conductive members in response to depression of the other one of said side portions of said button cap.

2. The selective switch as claimed in claim 1, wherein said movable contact member has a through hole formed therethrough, said flexible mandrel being generally L-shaped and having a straight body extending through said through hole of said movable contact member, said inner end portion of said flexible mandrel being generally straight and being perpendicular to said straight body so as to clamp said movable contact member between said helical spring and said inner end portion of said flexible mandrel, thereby retaining said spring member on said movable contact member.

3. The selective switch as claimed in claim 2, wherein said second conductive member has a cavity which includes a wider portion and a narrower portion that is communicated with said wider portion, said movable contact member being mounted slidably in said wider portion of said cavity, said inner end portion of said flexible mandrel being sized and positioned so as to pass through said narrower portion of said cavity when said movable contact member moves between said first and second positions.

4. The selective switch as claimed in claim 1, wherein said button cap has an inner surface formed with an annular flange which extends inwardly to define an elongated receiving space therein and which has a first end adjacent to said inner surface and a second end opposite to said first end, said outer end portion of said helical spring being received within said receiving space.

5. The selective switch as claimed in claim 4, wherein said receiving space has a circular cross-section which increases in diameter from said first end to said second end, whereby, when said button cap is depressed at either of said side portions, said outer end portion of said helical spring can be compressed within said annular flange.

* * * * *